US007513366B1

(12) United States Patent
Keating

(10) Patent No.: US 7,513,366 B1
(45) Date of Patent: Apr. 7, 2009

(54) METHOD AND PACKAGE FOR DISPLAYING SHOELACES

(75) Inventor: Steven W. Keating, West Portsmouth, OH (US)

(73) Assignee: Mitchellace, Inc., Portsmouth, OH (US)

( * ) Notice: Subject to any disclaimer, the term of this patent is extended or adjusted under 35 U.S.C. 154(b) by 0 days.

(21) Appl. No.: 11/970,926

(22) Filed: Jan. 8, 2008

(51) Int. Cl.
*B65D 73/00* (2006.01)
*B65D 85/04* (2006.01)
*B65D 85/18* (2006.01)

(52) U.S. Cl. ..... 206/495; 206/49; 206/288; 206/289; 206/477; 206/806

(58) Field of Classification Search ..... 206/278, 206/284, 285, 288, 289, 443, 477, 806; 211/54.1, 211/57.1, 59.1
See application file for complete search history.

(56) References Cited

U.S. PATENT DOCUMENTS 1,716,628 A * 6/1929 Gittleman ..... 221/63
2,185,100 A * 12/1939 Berolzheimer ..... 206/49
2,560,205 A * 7/1951 Andren ..... 53/399
2,839,185 A * 6/1958 Isaacs ..... 206/49
3,032,242 A * 5/1962 Roberts ..... 223/87
3,790,045 A * 2/1974 Rigel et al. ..... 223/87
3,872,968 A * 3/1975 Hawkins et al. ..... 206/278
3,997,091 A * 12/1976 Burnette ..... 223/87
4,219,140 A * 8/1980 Simonoff ..... 223/87
D391,157 S * 2/1998 Snitzer et al. ..... D9/415
D503,334 S * 3/2005 Keating ..... D9/415
2004/0055930 A1* 3/2004 Hsieh ..... 206/806

FOREIGN PATENT DOCUMENTS

WO WO 95/11175 * 10/1994

* cited by examiner

*Primary Examiner*—Jacob K Ackun, Jr.
*Assistant Examiner*—Jose S Stephens, III
(74) *Attorney, Agent, or Firm*—Sand & Sebolt

(57) ABSTRACT

A package and method for displaying shoelaces includes a backing member to which one end of the laces are attached by a strip of pressure sensitive adhesive. The laces are wrapped about the backing member and through an opening of a triangularly-shaped hanger to form a plurality of loops. A second strip of pressure sensitive adhesive is then wrapped about the loops and backing panel securing the looped laces to the hanger. A cover wrap is inserted through the hanger and folded over the upper portion of the looped laces, backing panel and base of the hanger. An informational panel is then wrapped about the cover wrap to secure the laces and backing member therein. The informational panel contains printed indicia pertaining to the shoelaces. A display rod is inserted through the hanger to suspend the packaged laces therefrom.

15 Claims, 5 Drawing Sheets

METHOD AND PACKAGE FOR DISPLAYING SHOELACES

BACKGROUND OF THE INVENTION

1. Technical Field

The invention relates to displaying fashion accessories. More particularly, the invention relates to the convenient hanging and displaying of shoelaces. Specifically, the invention enables customers in a retail setting to browse hanging shoelaces on display without tangling the shoelaces or opening the package.

2. Background Information

While shoelaces used to be solely a utility for holding shoes tight to a user's foot, they have become a fashion unto themselves in recent years. The standard white and black laces have been supplemented with all colors of the rainbow and patterns ranging from professional sports team emblems to cartoon characters. With this newly emerging fashion area come opportunities for retailers to increase sales. Due to the long, string-like nature of shoelaces, consumer-friendly displays are difficult. Non-packaged shoelaces are difficult to keep organized and presentable, and ultimately hard to sell.

Traditionally, fashion shoelaces are displayed in a tree-shaped stand, with "branches" holding laces looped at approximately half the length. However, this structure leads to laces getting tangled from users viewing and returning the laces to the branch. Another example of non-packaged shoelace displays are the "bin", where all the various shoelaces are placed and it's up to the user to pick through the bin and find the desired pattern. This takes a significant amount of time that a busy consumer is unlikely to spend, which leads to a missed opportunity for a sale.

Opaque and closed containers or boxes are undesirable for shoelace packaging because the customer can't see what pattern is being purchased. Users want to pick a design that makes a statement or shows off a particular personality. Transparent windows are used in packaging to show the user which pattern of laces the package contains. The disadvantages of this approach are that it eliminates the ability of the user to quickly shuffle through patterns, as well as denying a user the sense of touching the item. When shoelaces are folded and placed in a tube-shaped label, the label often slips off and leaves the user in confusion over the size and price. This leads to missed sales for the retailer.

Thus, the need exists for an improved package for displaying shoelaces which holds the shoelaces in a secure position when suspended from a display rack, yet which enables the logos and colors of the shoelaces to be readily viewed by a prospective purchaser.

BRIEF SUMMARY OF THE INVENTION

One aspect of the present invention is to provide a package for displaying the shoelaces in a compact condition wherein the laces remain attached to a back support member preventing them from becoming entangled with adjacent laces of other packages even during shipment, storage and repeated handling by perspective customers.

Another feature of the present invention is to enable any designs or logos on the laces to be readily seen by a perspective purchaser.

A further aspect of the invention is to secure the laces in a looped condition about the hanger to prevent the laces from accidently becoming dislodged from the hanger when repeatedly handled by a customer after the laces have been placed on a support rod or other attachment for displaying the same in a retail environment.

Still another aspect of the present invention is to provide a display package in which the shoelaces are arranged in a plurality of loops about a backing member and firmly secured to the backing member and prevented from becoming untangled by a transparent plastic end closure which is secured in a closed position about the shoelace loops, backing member and hanger by an informational wrap on which various data can be printed pertaining to the shoelaces such as color, style, size etc., as well as a UPC code.

These features and advantages are obtained by the improved shoelace display package of the present invention, the general nature of which may be stated as comprising at least one shoelace having an elongated body terminating in first and second ends; a hanger for suspending the package from a support structure; a backing member having first and second surfaces, wherein the elongated body of the shoelace is looped through the hanger and about the backing member forming a plurality of loops about the backing member; a first fastening member securing the first end of the shoelace to the first surface of the backing member; a second fastening member securing the second end of the shoelace and the formed loops to the backing member; a closure member extending through the hanger and enclosing at least a portion of the loops adjacent the hanger; and an informational panel wrapped about the closure member and loops to secure the closure member to the shoelace.

BRIEF DESCRIPTION OF THE SEVERAL VIEWS OF THE DRAWINGS

A preferred embodiment of the present invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
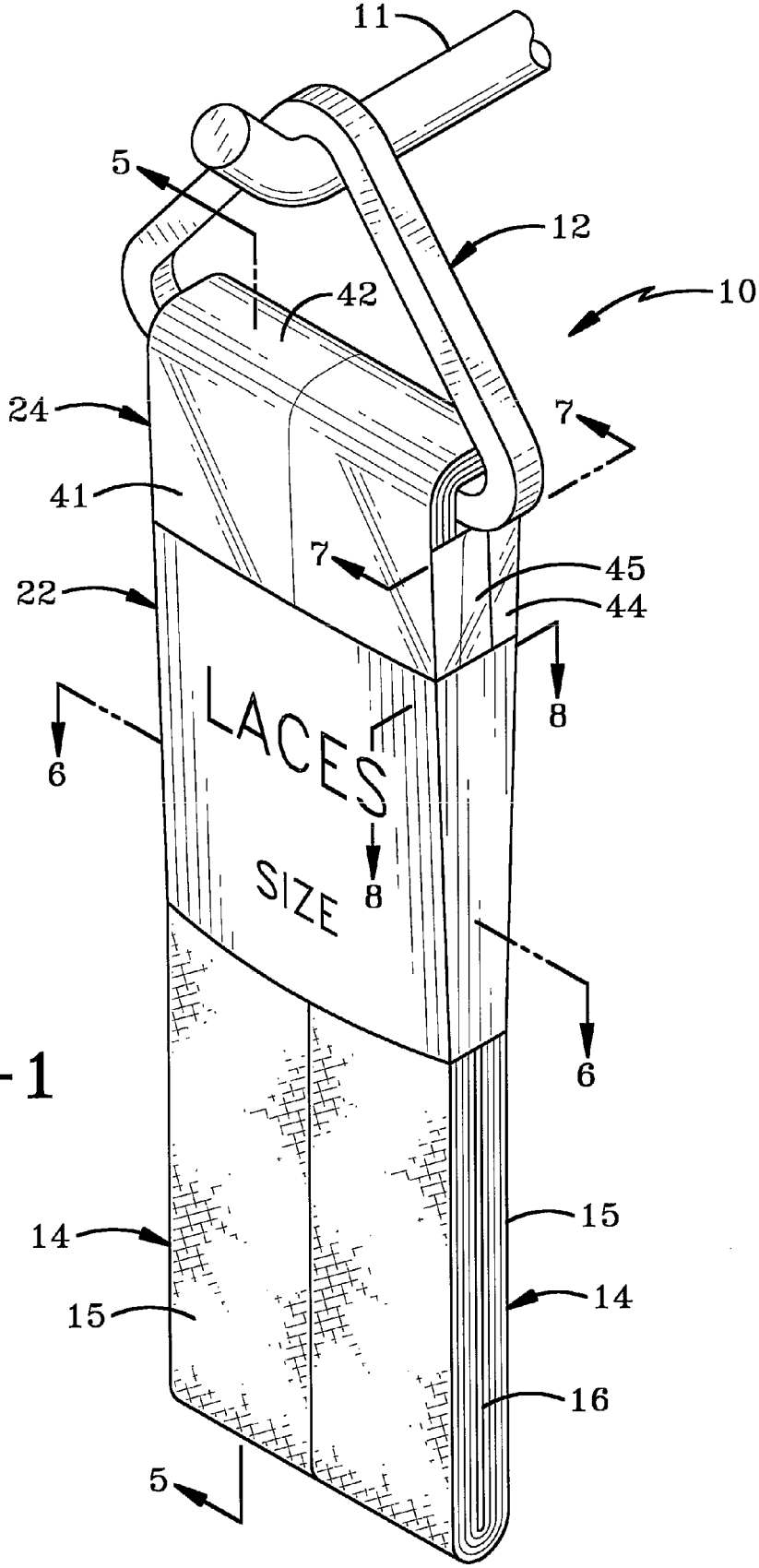
FIG. 1 is a perspective view of the shoelace display package of the present invention mounted on a display rod.
Figure 2:
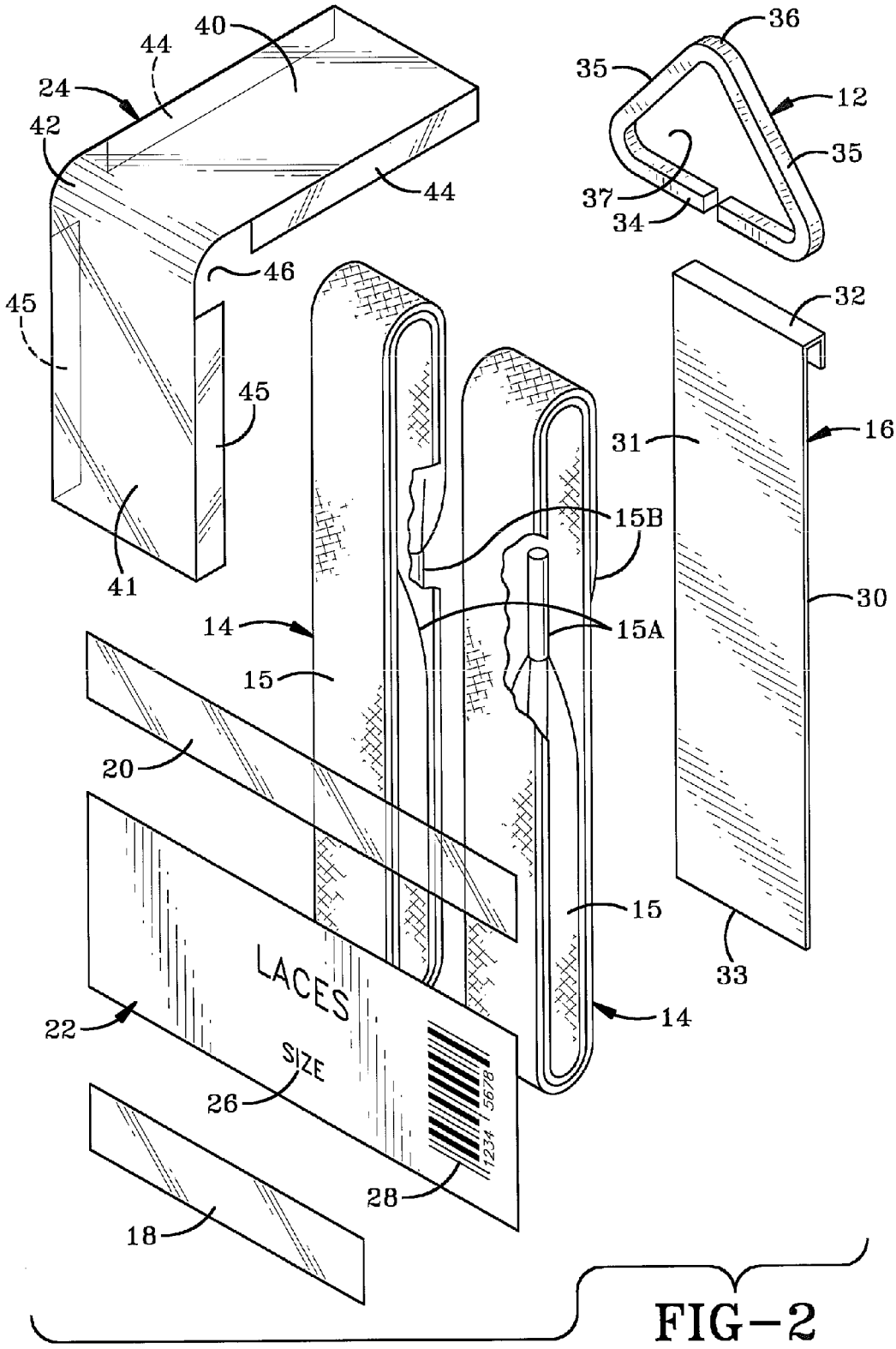
FIG. 2 is an exploded perspective view of the shoelace display package.

The shoelace display package of the present invention is indicated generally at 10, and is shown in FIG. 1 suspended from a display rod 11. Referring to FIG. 2, package 10 includes as its main components a generally triangularly-shaped hanger 12, a pair of shoelaces 14, a backing support member 16, two pieces of double sided adhesive fastening tapes 18 and 20, an information panel wrap 22 and a top closure member 24. Shoelaces 14 can be of various constructions such as woven of various types of threads and yarns, rawhide etc. without affecting the invention. The shoelaces have an elongated main body 15 and a pair of sealed ends 15A and 15B.

Panel wrap 22 preferably contains printed indicia 26 relating to the shoelaces package therein such as size, style, color, price etc. It also may contain a universal product code 28. Wrap 22 preferably is formed of a thin, easily foldable cardboard which can be easily printed with the desired information and then wrapped about the looped laces and secured thereto as discussed below. Backing support member 16 is a generally elongated flat planar piece of material such as cardboard, plastic etc. and has opposed planar surfaces 30 and 31 and a generally U-shaped upper end 32 and a lower end 33. Hanger 12 preferably has a triangular configuration and is formed with a split base 34 and a pair of angularly extending sides 35 which terminate in an apex 36 and forming an opening 37. Hanger 12 preferably is formed out of metal or a rigid plastic material.

Top closure member 24 preferably is formed of a transparent plastic material having a generally elongated flat planar configuration with a pair of end panel portions 40 and 41 which are hingedly connected together by an integrally formed flexible hinge 42. Each end panel portion 40 and 41 is formed with a pair of side flaps or flanges 44 and 45 respectively, which are separated by intervening cutouts 46 in order to form and provide flexibility to hinge 42. If desired, information pertaining to the shoelaces can be printed directly on one or both end panels 40 and 41 which are sealed about the laces eliminating the need for panel wrap 22, or panel 22 could still be used but be transparent.

Figure 3:
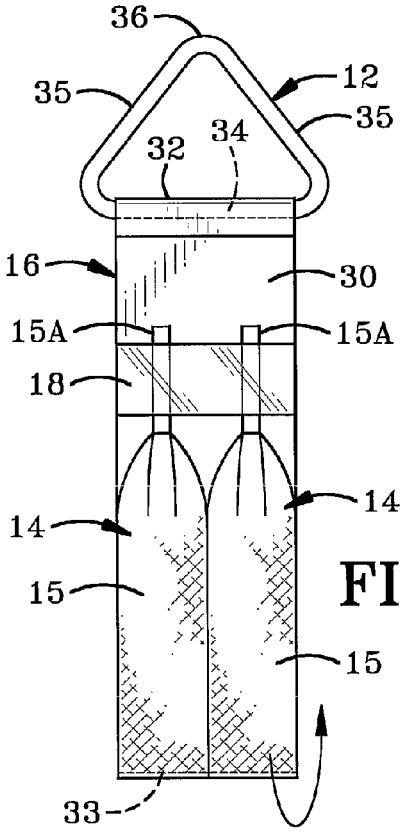
FIG. 3 is a fragmentary plan view showing the initial attachment of the pair of shoelaces to the backing support member.
Figure 4:
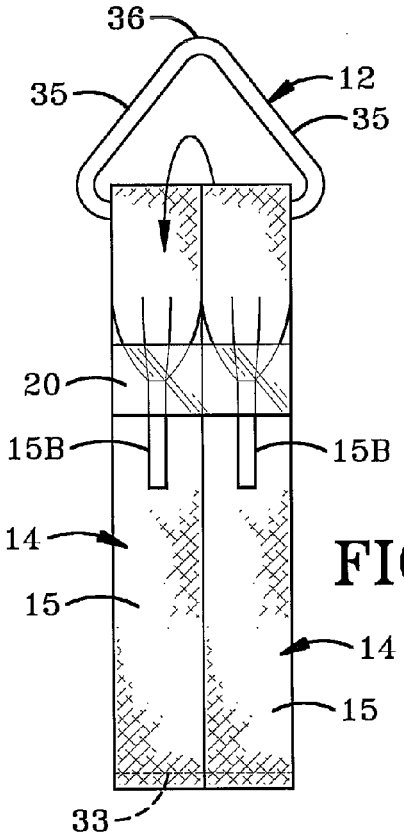
FIG. 4 is a fragmentary plan view showing the attachment of the looped shoelaces to the hanger and backing support member.
Figure 5:
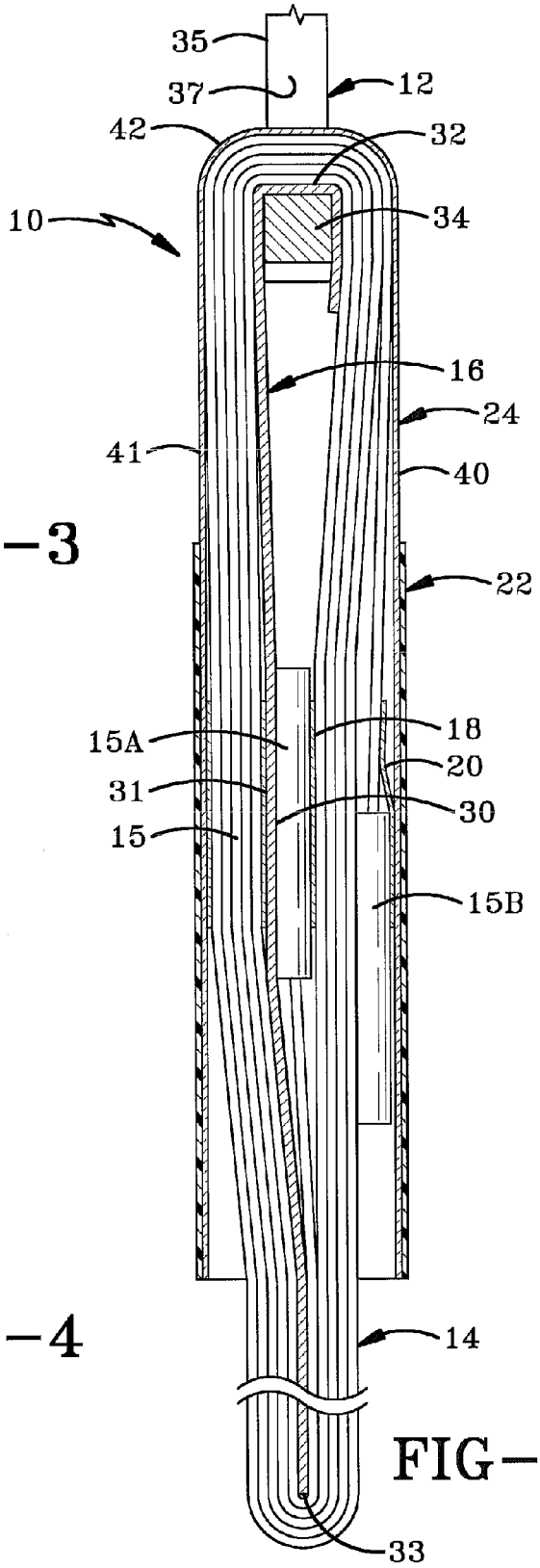
FIG. 5 is an enlarged sectional view taken on line 5-5, FIG. 1.
Figure 6:
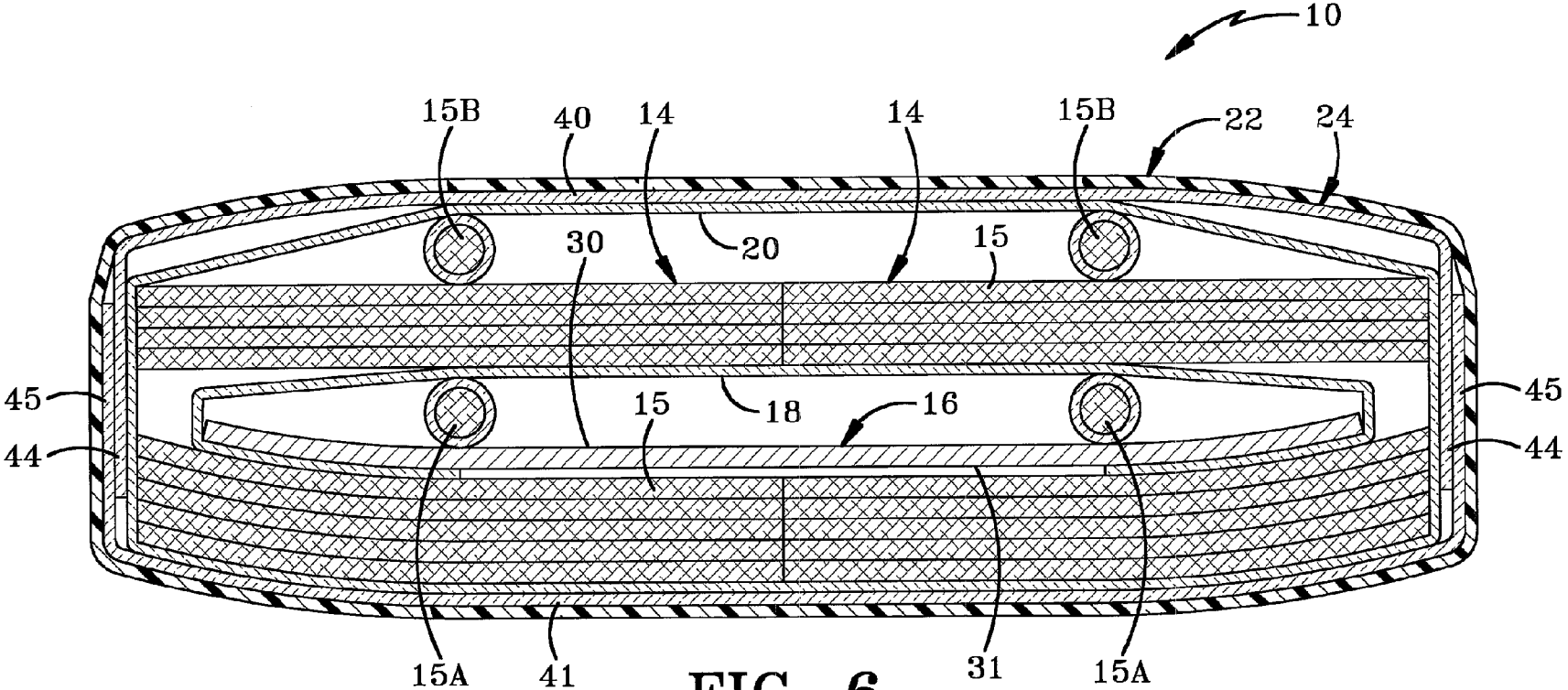
FIG. 6 is an enlarged sectional view taken on line 6-6, FIG. 1.
Figure 7:
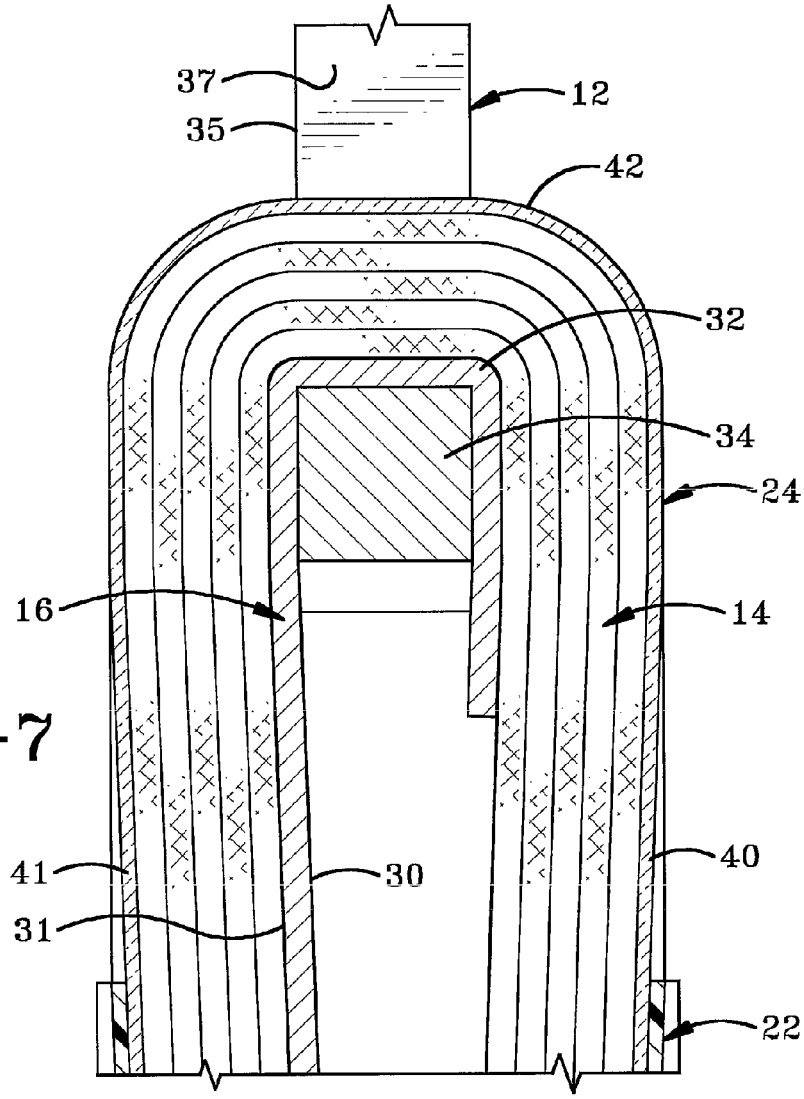
FIG. 7 is an enlarged fragmentary sectional view taken on line 7-7, FIG. 1.

In accordance with one of the features of the invention, the improved method of assembling and packaging shoelaces 14 in the final display package 10 is shown diagrammatically in FIGS. 3-8. At the start of the packaging procedure, shoelace ends 15A are initially attached to planar surface 30 of backing support member 16 by the first strip of fastening tape 18 as shown in FIG. 3. Tape 18 preferably has a pressure sensitive adhesive on both sides thereof. After attaching shoelace ends 15A to support member 16, the elongated main body 15 of each shoelace is wound into a plurality of loops, with each of the loops passing through opening 37 of hanger 12 and around both flat planar side surfaces of backing panel members 16 as shown in FIG. 4. This forms a series of loops such as shown in FIGS. 5 and 6. Also, at the start of this loop forming operation, U-shaped upper end 32 of panel member 16 is engaged over hanger base 34 as shown in FIG. 5 and subsequently covered by the individual loops of the shoelaces. As shown in FIG. 5, the shoelaces form elongated loops extending throughout the longitudinal length of support member 16 from upper end 32 and around lower end 33. After completion of this loop forming procedure, shoelace ends 15B will reach the general position as shown in FIG. 4 where they are secured in position by the second flexible strip of fastening tape 20 which preferably extends across shoelace ends 15B and around intervening backing panel member 16 where the strip is sealed by the pressure sensitive adhesive preferably formed on both sides of tape 20. The adhesive on the outer exposed side of tape 18 (FIG. 3) will adhere to the adjacent shoelace loop assisting in retaining the formed loops wound about backing member 16.

Figure 8:
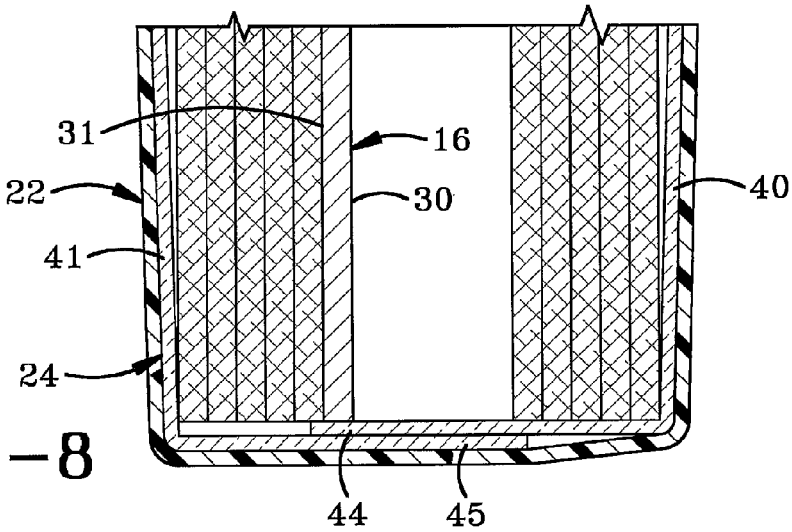
FIG. 8 is an enlarged fragmentary sectional view taken on line 8-8, FIG. 1

After securing the looped shoelaces onto backing member 16 by the wrapping and securement of tape 20 around the shoelaces and intervening member panel 16, one end of closure member 24 is inserted through central opening 37 of hanger 12 and moved to a closed position such as shown in FIG. 1 with side flanges 44 and 45 overlapping each other as shown particularly in FIG. 8 which traps and secures the looped laces onto hanger 12. Next, informational panel 22 is wrapped about the lower end of top closure member panels 40 and 41 and secured thereon preferably by an adhesive, preferably pressure sensitive, on the back surface of information panel 22. This permanently secures informational panel 22 about the loop laces and closure member 24 in a closed position about hanger base 34 and the upper portions of the shoelace loops and upper end 32 of backing member 16. This prevents removal of the laces from the hanger without first removing informational panel 22 and top closure member 24 from the adhered position completely about the ends of panels 40 and 41. In the secured position as shown in FIG. 1, the ends of hanger base 34 extend through gaps formed by flange cutouts 46.

Thus, when in this final assembled position as shown in FIG. 1, the laces remain secured about backing support member 16 since the upper ends of the loops are tightly secured thereto by end closure member 24 and informational wrap 22 and cannot easily slide off backing panel 16 about which the laces are looped. Furthermore, the laces cannot be stolen or removed from the mounting bracket or become loose accidently due to the securement of the upper looped ends of the shoelaces about hanger base 34 where they are trapped by closure member 24 and informational panel 22. Thus, when being purchased by a customer, the customer merely slips the support hanger 12 off of display rod 11 and takes the hanger with the laces attached for purchase at a checkout counter. Due to the extremely simple design and inexpensive material required to form hanger 12, the same can remain with the laces when removed by a customer.

Package 10 enables the laces to be displayed in a readily viewable condition where they do not become entangled with adjacent laces stored on the same or adjacent support rod even if repeatedly handled by a customer since the laces are secured in a looped position on backing member 16 and about hanger base 34 where they are subsequently secured by top closure member 24 and informational panel 22. Preferably, backing member 16 has an elongated rectangular configuration and is formed of a relatively thin material such as cardboard, plastic, etc. wherein its length is considerably longer than its width. For example, a width of 1⅜ inches and a length of 4⅜ inches. However, this may vary without affecting the invention. This package provides an attractive display of the laces as shown in FIG. 1 wherein the complete lower half of the loops are visible to a perspective customer enabling the customer to view any design which can be on the lace, as well as the color thereof.

Furthermore, if top closure member 24 is formed of a transparent plastic material as in the preferred embodiment, the upper portion of the lace is also viewable to a perspective customer enabling him or her to see the particular fashion design and logo on the lace. Also, the tapered sealed ends 15A and 15B of the laces are not exposed since end 15A is attached to the backing panel intermediate the loops with the opposite ends 15B being secured to the adjacent loop and covered by the one of the end panel portions of closure member 24 and informational panel 22. Furthermore, the double sided adhesive of fastening strips 18 and 20 assist in securing the formed loops together and attached to support member 16 and closure member 24, which is then further secured together by informational panel 22 which wraps completely about panels 40 and 41 of closure member 24. Thus, the improved package of the present invention provides an extremely simple, yet efficient device for displaying shoelaces, as well as a unique method of packaging the shoelaces for subsequent display in a retail establishment.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A shoelace display package comprising:

at least one shoelace having an elongated body terminating in first and second ends;

a hanger for suspending the package from a support structure;

a backing member having first and second surfaces, wherein the elongated body of the shoelace is looped through the hanger and about said backing member forming a plurality of loops about the backing member;

a first fastening member securing the first end of the shoelace to the first surface of the backing member;

a second fastening member securing the second end of the shoelace and the formed loops to the backing member; and a closure member extending through the hanger and enclosing at least a portion of the loops adjacent the hanger.

2. The display package defined in claim 1 wherein an informational panel is wrapped about the closure member and shoelace loops to secure the closure member to the shoelace.

3. The display package defined in claim 1 wherein the first and second fastening members are flexible strips of material having an adhesive on at least one side of the strip.

4. The display package defined in claim 3 wherein the strips of material have opposed sides; and in which the adhesive is on both sides of the strips.

5. The display package defined in claim 1 wherein the closure member includes a pair of panels hingedly connected by a flexible hinge; and in which each of the panels includes a pair of side flaps which overlap each other when the closure member encloses a portion of the loops.

6. The display package defined in claim 5 wherein the closure member is formed of a transparent plastic material.

7. The display package defined in claim 1 wherein the closure member is an elongated strip of material providing a pair of end panels hingedly joined by an intervening flexible hinge; and in which side flaps extend along opposed edges of each of the panels.

8. The display package defined in claim 2 wherein the information panel contains printed indicia identifying features of the shoelace.

9. The display package defined in claim 1 wherein the hanger is triangularly shaped having a base and a pair of side members angularly extending from the base and terminating in an apex and forming an opening therebetween; and in which the loops of the shoelace and closure member extend over said base and through said opening.

10. The display package defined in claim 1 wherein the backing member is an elongated rectangular-shaped thin strip of material having a length and width wherein the length is considerably greater than the width; in which the strip has first and second pairs of opposed edges; said first edges being longer than said second edges; and in which the loops are formed about the second edges.

11. The display package defined in claim 10 wherein one of the second edges is U-shaped and engages a base of the hanger.

12. A shoelace display package comprising:

a hanger for suspending the package from a support structure;

a backing member;

a pair of shoelaces, each having an elongated body terminating in first and second ends and formed into a plurality of loops about the backing member and about a portion of the hanger;

at least one fastening member securing the shoelace loops to the backing member;

a closure member extending through the hanger and enclosing at least a portion of the loops adjacent the hanger; and a second fastening member wrapped about the closure member and loops to secure the closure member to the shoelace and the shoelace loops to the backing member.

13. The display package defined in claim 12 wherein the at least one fastening member includes a pair of the fastening strips, each being formed of a flexible material having an adhesive on at least one side of the strip.

14. The display package defined in claim 12 wherein the closure member includes a pair of panels hingedly connected by a flexible hinge; and in which each of the panels includes a pair of side flaps which overlap each other when the closure member encloses a portion of the loops.

15. The display package defined in claim 12 wherein the hanger is triangularly shaped having a base and a pair of side members angularly extending from the base and terminating in an apex and forming an opening therebetween; and in which the loops of the shoelace and closure member extend over said base and through said opening.

* * * * *